US010726788B2

(12) United States Patent
Qin et al.

(10) Patent No.: US 10,726,788 B2
(45) Date of Patent: Jul. 28, 2020

(54) PIXEL CIRCUIT, PIXEL DRIVING METHOD AND ORGANIC LIGHT-EMITTING DIODE DISPLAY DEVICE

(71) Applicant: BOE TECHNOLOGY GROUP CO., LTD., Beijing (CN)

(72) Inventors: Guohong Qin, Beijing (CN); Xiaochuan Chen, Beijing (CN); Shengji Yang, Beijing (CN); Pengcheng Lu, Beijing (CN); Rongrong Shi, Beijing (CN); Weihai Wang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/406,870

(22) Filed: May 8, 2019

(65) Prior Publication Data

US 2020/0051503 A1 Feb. 13, 2020

(30) Foreign Application Priority Data

Aug. 10, 2018 (CN) ..... 2018 1 0910972

(51) Int. Cl.
*G09G 3/3258* (2016.01)
*G09G 3/3275* (2016.01)

(52) U.S. Cl.
CPC ..... *G09G 3/3258* (2013.01); *G09G 3/3275* (2013.01); *G09G 2320/0626* (2013.01)

(58) Field of Classification Search
CPC ..... G09G 3/3258; G09G 3/3275; G09G 2320/0626
See application file for complete search history.

(56) References Cited

U.S. PATENT DOCUMENTS

2009/0122043 A1 5/2009 Hsueh et al.
2014/0168038 A1* 6/2014 Kim ..... G09G 3/3208 345/82

(Continued)

FOREIGN PATENT DOCUMENTS

CN 1873755 A 12/2006
CN 104809984 A 7/2015

(Continued)

OTHER PUBLICATIONS

First Office Action for Chinese Application No. 201810910972.2, dated Nov. 1, 2019, 9 Pages.

*Primary Examiner* — Andrew Sasinowski
(74) *Attorney, Agent, or Firm* — Brooks Kushman P.C.

(57) ABSTRACT

A pixel circuit includes a data write-in circuit, a voltage amplification circuit, an energy storage circuit, a driving circuit and a light-emitting element. The driving circuit includes a control end, a first end and a second end. The voltage amplification circuit is connected to a data write-in node and the control end of the driving circuit, and configured to amplify a data voltage to acquire a driving voltage, and output the driving voltage to the control end of the driving circuit. The energy storage circuit is connected to the control end of the driving circuit. The first end of the driving circuit is connected to a power source voltage end, and the second end of the driving circuit is connected to an anode of the light-emitting element. The driving circuit is configured to control the power source voltage end to be electrically connected to, or electrically disconnected from, the anode of the light-emitting element under the control of the control end. A cathode of the light-emitting element is connected to a cathode voltage end.

18 Claims, 3 Drawing Sheets

(56) References Cited

U.S. PATENT DOCUMENTS

| | | | | |
|---|---|---|---|---|
| 2015/0302802 | A1 | 10/2015 | Song et al. | |
| 2017/0287405 | A1 | 10/2017 | Tseng | |
| 2017/0372657 | A1* | 12/2017 | Yamamura ..... | G09G 3/3233 |

FOREIGN PATENT DOCUMENTS

| | | | |
|---|---|---|---|
| CN | 103354081 | A | 10/2016 |
| TW | 200921615 | A | 5/2009 |

* cited by examiner

PIXEL CIRCUIT, PIXEL DRIVING METHOD AND ORGANIC LIGHT-EMITTING DIODE DISPLAY DEVICE

CROSS-REFERENCE TO RELATED APPLICATION

This application claims priority to Chinese Patent Application No. 201810910972.2 filed on Aug. 10, 2018, which is incorporated herein by reference in its entirety.

TECHNICAL FIELD

The present disclosure relates to the field of display technology, in particular to a pixel circuit, a pixel driving method, and an organic light-emitting diode (OLED) display device.

BACKGROUND

For a conventional OLED pixel circuit, a driving current flowing through an OLED is controlled through a driving transistor operating at a saturated region. During the operation of the pixel circuit, a data voltage signal of a data line is written into a gate electrode of the driving transistor under the control of a gate line, and then a corresponding driving current signal is outputted in accordance with an output characteristic of the driving transistor at the saturated region, so as to drive the OLED to emit light with a corresponding grayscale brightness. The grayscale brightness of the OLED in the conventional pixel circuit is directly determined by the data voltage signal of the data line, so it is difficult to provide larger grayscale brightness.

SUMMARY

In one aspect, the present disclosure provides in some embodiments a pixel circuit, including a data write-in circuit, a voltage amplification circuit, an energy storage circuit, a driving circuit and a light-emitting element. The driving circuit includes a control end, a first end and a second end. The data write-in circuit is connected to a gate line, a data line and a data write-in node, and configured to write a data voltage across the data line into the data write-in node under the control of the gate line. The voltage amplification circuit is connected to the data write-in node and the control end of the driving circuit, and configured to amplify the data voltage to acquire a driving voltage, and output the driving voltage to the control end of the driving circuit. The energy storage circuit is connected to the control end of the driving circuit, and configured to maintain a potential at the control end of the driving circuit. The first end of the driving circuit is connected to a power source voltage end, and the second end of the driving circuit is connected to an anode of the light-emitting element. The driving circuit is configured to control the power source voltage end to be electrically connected to, or electrically disconnected from, the anode of the light-emitting element under the control of the control end. A cathode of the light-emitting element is connected to a cathode voltage end.

In a possible embodiment of the present disclosure, the voltage amplification circuit includes a conversion sub-circuit, a current amplification sub-circuit, a first resistor sub-circuit and a second resistor sub-circuit. A first end of the first resistor sub-circuit is connected to a first voltage end, and a second end of the first resistor sub-circuit is connected to the control end of the driving circuit. A first end of the second resistor sub-circuit is connected to the control end of the driving circuit. The conversion sub-circuit is connected to the data write-in node and a conversion node, and configured to convert the data voltage written into the data write-in node into a data current, and output the data current through the conversion node. The current amplification sub-circuit is connected to the conversion node and a second end of the second resistor sub-circuit, and configured to amplify the data current to acquire an amplified data current, and output the amplified data current to the second resistor sub-circuit and the first resistor sub-circuit, so as to control the potential at the control end of the driving circuit to be the driving voltage.

In a possible embodiment of the present disclosure, the conversion sub-circuit includes a conversion transistor, a gate electrode of which is connected to the data write-in node, a first electrode of which is connected to a second voltage end, and a second electrode of which is connected to the conversion node.

In a possible embodiment of the present disclosure, the current amplification sub-circuit includes a capacitor sub-circuit, a resistor sub-circuit, an amplification transistor, and a current source. A first end of the capacitor sub-circuit is connected to the conversion node, and a second end of the capacitor sub-circuit is connected to a third voltage end. A first end of the resistor sub-circuit is connected to the conversion node, and a second end of the resistor sub-circuit is connected to a base of the amplification transistor. A collector of the amplification transistor is connected to the second end of the second resistor sub-circuit, and an emitter of the amplification transistor is connected to a fourth voltage end through the current source. The current source is configured to provide a current flowing from the emitter of the amplification transistor to the fourth voltage end.

In a possible embodiment of the present disclosure, the driving circuit includes a driving transistor, a gate electrode of which is the control end of the driving circuit, a first electrode of which is the first end of the driving circuit, and a second electrode of which is the second end of the driving circuit.

In a possible embodiment of the present disclosure, the energy storage circuit includes a storage capacitor, a first end of which is connected to the control end of the driving circuit, and a second end of which is connected to a fifth voltage end.

In a possible embodiment of the present disclosure, the data write-in circuit includes a data write-in transistor, a gate electrode of which is connected to the gate line, a first electrode of which is connected to the data line, and a second electrode of which is connected to the data write-in node.

In a possible embodiment of the present disclosure, the light-emitting element is an OLED, an anode of which is the anode of the light-emitting element, and a cathode of which is the cathode of the light-emitting element.

In another aspect, the present disclosure provides in some embodiments a method for driving the above-mentioned pixel circuit, including: writing, by the data write-in circuit, a data voltage of the data line into the data write-in node under the control of the gate line; amplifying, by the voltage amplification circuit, the data voltage to acquire a driving voltage, and outputting the driving voltage to the control end of the driving circuit; maintaining, by the energy storage circuit, a potential at the control end of the driving circuit; and controlling, by the driving circuit, the power source voltage end to be electrically connected to, or electrically disconnected from, the light-emitting element under the control of the control end.

In a possible embodiment of the present disclosure, the voltage amplification circuit includes a conversion sub-circuit, a current amplification sub-circuit, a first resistor sub-circuit and a second resistor sub-circuit. A driving period includes a data write-in stage, an amplification stage and a driving stage. The method includes: at the data write-in stage, writing, by the data write-in circuit, the data voltage of the data line into the data write-in node under the control of the gate line, converting, by the conversion sub-circuit, the data voltage into a data current, and outputting the data current through the conversion node; at the amplification stage, amplifying, by the current amplification sub-circuit, the data current to acquire an amplified data current, transmitting the amplified data current to the second resistor sub-circuit and the first resistor sub-circuit to control the potential at the control end of the driving circuit to be the driving voltage, and maintaining, by the energy storage circuit, the potential at the control end of the driving circuit; and at the driving stage, outputting a high power source voltage by the power source voltage end, inputting a low voltage by a cathode voltage end, and driving, by the driving circuit, the light-emitting element to emit light under the control of the control end.

In yet another aspect, the present disclosure provides in some embodiments an OLED display device including the above-mentioned pixel circuit.

In a possible embodiment of the present disclosure, the OLED display device further includes a silicon substrate on which the pixel circuit is arranged.

In a possible embodiment of the present disclosure, the pixel circuit includes a data write-in circuit, a voltage amplification circuit and a driving circuit. The data write-in circuit includes a data write-in transistor, the voltage amplification circuit includes a conversion transistor, and the driving circuit includes a driving transistor. The data write-in transistor is a metal-oxide-semiconductor (MOS) field effect transistor (FET) or thin film transistor (TFT), and the conversion transistor and the driving transistor are both MOSFETs.

In a possible embodiment of the present disclosure, the OLED display device further includes a circuit board arranged at a side of the silicon substrate. The pixel circuit includes a voltage amplification circuit, and the voltage amplification circuit includes a first resistor sub-circuit arranged on the circuit board. Members of the pixel circuit, other than the first resistor sub-circuit, are arranged on the silicon substrate.

DETAILED DESCRIPTION

Figure 1:
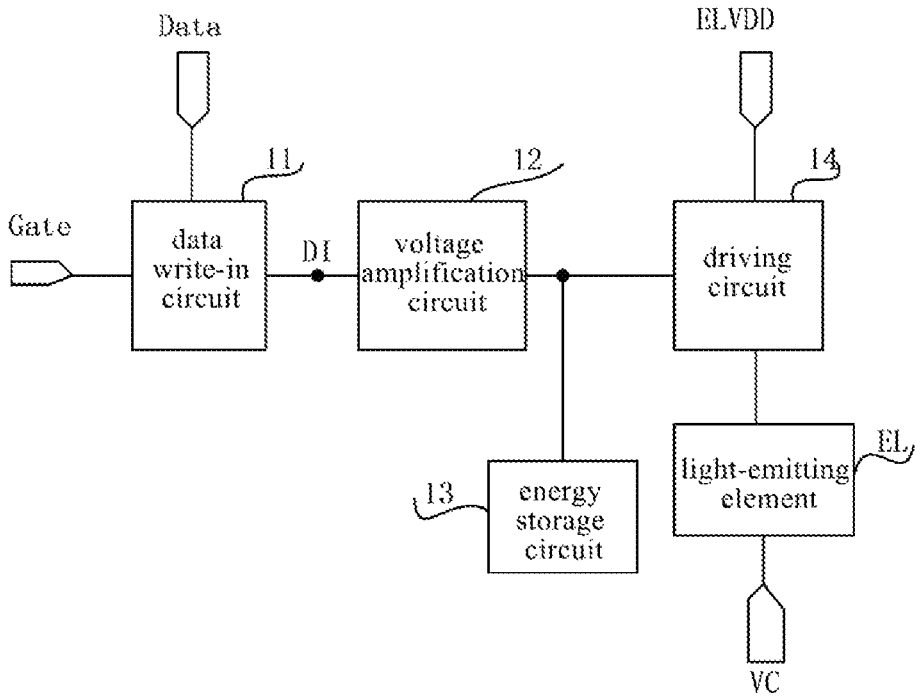
FIG. 1 is a schematic view showing a pixel circuit according to one embodiment of the present disclosure.

In order to make the objects, the technical solutions and the advantages of the present disclosure more apparent, the present disclosure will be described hereinafter in a clear and complete manner in conjunction with the drawings and embodiments. Obviously, the following embodiments merely relate to a part of, rather than all of, the embodiments of the present disclosure, and based on these embodiments, a person skilled in the art may, without any creative effort, obtain the other embodiments, which also fall within the scope of the present disclosure.

All transistors adopted in the embodiments of the present disclosure may be TFTs, FETs or any other elements having an identical characteristic. In order to differentiate two electrodes other than a gate electrode from each other, one of the two electrodes is called as first electrode and the other is called as second electrode. In actual use, the first electrode may be a drain electrode while the second electrode may be a source electrode, or the first electrode may be a source electrode while the second electrode may be a drain electrode.

The present disclosure provides in some embodiments a pixel circuit, which includes a data write-in circuit 11, a voltage amplification circuit 12, an energy storage circuit 13, a driving circuit 14 and a light-emitting element EL. The driving circuit 14 includes a control end, a first end and a second end. The data write-in circuit 11 is connected to a gate line Gate, a data line Data and a data write-in node DI, and configured to write a data voltage of the data line Data into the data write-in node DI under the control of the gate line Gate. The voltage amplification circuit 12 is connected to the data write-in node DI and the control end of the driving circuit 14, and configured to amplify the data voltage to acquire a driving voltage, and output the driving voltage to the control end of the driving circuit 14. The energy storage circuit 13 is connected to the control end of the driving circuit 14, and configured to maintain a potential at the control end of the driving circuit 14. The first end of the driving circuit 14 is connected to a power source voltage end ELVDD, and the second end of the driving circuit 14 is connected to a first electrode of the light-emitting element EL. The driving circuit 14 is configured to control the power source voltage end ELVDD to be electrically connected to, or electrically disconnected from, the first electrode of the light-emitting element EL under the control of the control end. A second electrode of the light-emitting element EL is connected to a cathode voltage end VC.

According to the pixel circuit in the embodiments of the present disclosure, through the additional voltage amplification circuit 12, the data voltage may be amplified and outputted to the driving circuit 14 so as to drive the light-emitting element EL to emit light. As compared with the related art, a larger driving current is applied to the driving circuit 14, so it is able to provide a larger brightness value.

During the implementation, the voltage amplification circuit may include a conversion sub-circuit, a current amplification sub-circuit, a first resistor sub-circuit and a second resistor sub-circuit. A first end of the first resistor sub-circuit is connected to a first voltage end, and a second end of the first resistor sub-circuit is connected to the control end of the driving circuit. A first end of the second resistor sub-circuit is connected to the control end of the driving circuit. The conversion sub-circuit is connected to the data write-in node and a conversion node, and configured to convert the data voltage written into the data write-in node into a corresponding data current, and output the data current through the conversion node. The current amplification sub-circuit is connected to the conversion node and a second end of the second resistor sub-circuit, and configured to amplify the data current to acquire an amplified data current, and output the amplified data current to the second resistor sub-circuit and the first resistor sub-circuit, so as to control the potential at the control end of the driving circuit to be the driving voltage.

Figure 2:
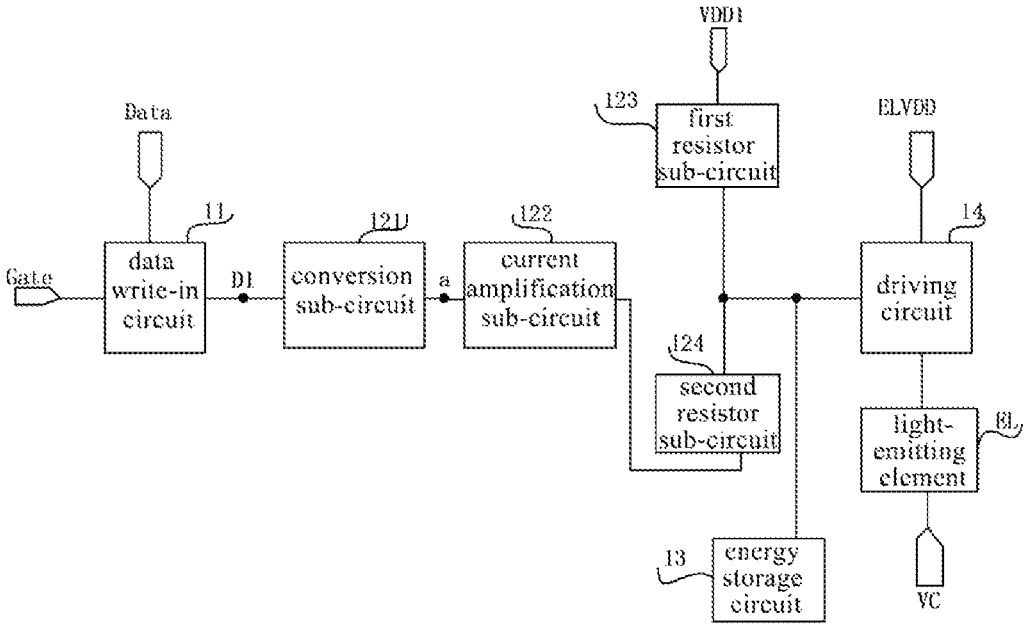
FIG. 2 is a circuit diagram of the pixel circuit according to one embodiment of the present disclosure.

On the basis of the structure in FIG. 1, as shown in FIG. 2, the voltage amplification circuit may include a conversion sub-circuit 121, a current amplification sub-circuit 122, a first resistor sub-circuit 123 and a second resistor sub-circuit 124.

A first end of the first resistor sub-circuit 123 may be connected to the first voltage end VDD1, and a second end of the first resistor sub-circuit 123 may be connected to the control end of the driving circuit 14. A first end of the second resistor sub-circuit 124 may be connected to the control end of the driving circuit 14.

The conversion sub-circuit 121 may be connected to the data write-in node DI and the conversion node a, and configured to convert the data voltage written into the data write-in node DI into a corresponding data current, and output the data current through the conversion node a.

The current amplification sub-circuit 122 may be connected to the conversion node a and a second end of the second resistor sub-circuit 124, and configured to amplify the data current to acquire an amplified data current, and output the amplified data current to the second resistor sub-circuit 124 and the first resistor sub-circuit 123, so as to control the potential at the control end of the driving circuit 14 to be the driving voltage.

During the operation of the pixel circuit in FIG. 2, the conversion sub-circuit 121 may convert the data voltage into the data current, and then current amplification sub-circuit 122 may amplify the data current to acquire the amplified data current, and then apply the amplified data current to the first resistor sub-circuit 123, so as to control the potential at the control end of the driving circuit 14 to be the driving voltage.

To be specific, the conversion sub-circuit may include a conversion transistor, a gate electrode of which is connected to the data write-in node, a first electrode of which is connected to a second voltage end, and a second electrode of which is connected to the conversion node.

To be specific, the current amplification sub-circuit may include a capacitor sub-circuit, a resistor sub-circuit, an amplification transistor, and a current source. A first end of the capacitor sub-circuit is connected to the conversion node, and a second end of the capacitor sub-circuit is connected to a third voltage end. A first end of the resistor sub-circuit is connected to the conversion node, and a second end of the resistor sub-circuit is connected to a base of the amplification transistor. A collector of the amplification transistor is connected to the second end of the second resistor sub-circuit, and an emitter of the amplification transistor is connected to a fourth voltage end through the current source. The current source is configured to provide a current flowing from the emitter of the amplification transistor to the fourth voltage end.

Figure 3:
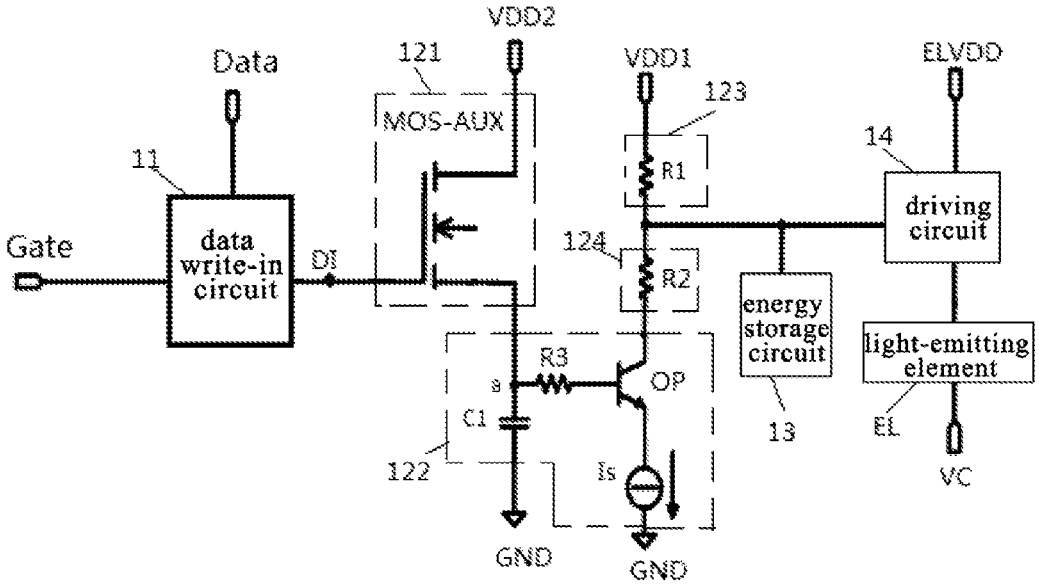
FIG. 3 is another circuit diagram of the pixel circuit according to one embodiment of the present disclosure.

On the basis of the pixel circuit in FIG. 2, as shown in FIG. 3, the first resistor sub-circuit 123 may include a first resistor R1, a first end of which is connected to the first voltage end VDD1, and a second end of which is connected to the control end of the driving circuit 14.

The second resistor sub-circuit 124 may include a second resistor R2, a first end of which is connected to the control end of the driving circuit 14.

The conversion sub-circuit 121 may include a conversion transistor MOS-AUX. The current amplification sub-circuit 122 may include a first capacitor C1, a third resistor R3, an amplification transistor OP and a current resource Is.

A gate electrode of MOS-AUX may be connected to the data write-in node DI, a drain electrode thereof may be connected to a second voltage end VDD2, and a source electrode thereof may be connected to the conversion node a. A first end of C1 may be connected to the conversion node a, and a second end thereof may be connected to a ground end GND. A first end of R3 may be connected to the conversion node a. A base of OP may be connected to a second end of R3, a collector thereof may be connected to a second end of D2, and an emitter thereof may be connected to the ground end GND via Is. Is is configured to provide a stable current to the current amplification sub-circuit 122.

In FIG. 3, each of the third voltage end and the fourth voltage end may be, but not limited to, the ground end. In actual use, the third voltage end and the fourth voltage end may also be low voltage ends.

In FIG. 3, a control node b is a node connected to the control end of the driving circuit 14, and OP is a common-emitter amplification transistor.

In FIG. 3, MOS-AUX is an N-channel MOS (NMOS) FET, and OP is an NPN-type transistor. However, the types of MOS-AUX and OP will not be particularly defined herein.

In FIG. 3, R2 and R3 each have a relatively small resistance, the resistance of R3 is far less than that of R1, and R1 is arranged at a peripheral circuit board. In the embodiments of the present disclosure, through the current amplification sub-circuit 122 of the pixel circuit, it is able to amplify a tiny current signal. In addition, a thin signal line may be provided for a pixel driving circuit (this is because R2 and R3 arranged on a display substrate (which may be a silicon substrate) each have a small resistance), so it is able to reduce a size of the silicon wafer, and increase an integration level of the silicon based OLED pixel circuit.

During the implementation, in order to meet the integration requirement on a semiconductor silicon substrate, the signal line for the pixel circuit is very thin, and a current flowing through the signal line is relatively small. Through the common-emitter amplification circuit in the embodiments of the present disclosure, it is able to amplify the tiny current signal, so as to facilitate an integration process for the semiconductor silicon substrate.

During the operation of the pixel circuit in FIG. 3, at a data write-in stage, the data write-in circuit 11 may write the data voltage Vdata of the data line Data into the data write-in node DI under the control of the gate line Gate, and VDD2 may output a second high level Vdd2, so as to enable a gate-to-source voltage Vgs-a and a gate-to-drain voltage Vgd-a of MOS-AUX to be each greater than a threshold voltage Vth-a of MOS-AUX, thereby to control MOS-AUX to operate at a saturated region. At this time, Vdata may be converted by MOS-AUX into the data current Ia, and then the data current Ia may flow from VDD2 to the conversion node a.

At an amplification stage, VDD1 may output a first high level Vdd1. At this time, Ub is greater than Ua, i.e., a potential at the collector of OP is greater than a voltage at the base of OP, so that OP may operate in an amplification state and $Ib=\beta*Ia$, where $\beta$ represents a current amplification actor when OP is in the amplification state, and Ib represents the amplified data current. Ib may flow from VDD1 to the control node b, and $Ub=Ib*R2=\beta*Ia*R2$. At this time, Ub may be just the driving voltage. The potential at the control node b may be maintained by the energy storage circuit 13, and the driving voltage may be greater than the data voltage Vdata.

At a driving stage, the power source voltage end ELVDD may output a high power source voltage, and the cathode voltage end VC may output a low voltage, so that the driving circuit 14 may drive the light-emitting element EL to emit light under the control of the control end. Because the voltage at the control end of the driving circuit 14 is greater than the data voltage Vdata, the driving circuit 14 may generate a larger driving current as compared with the related art, so it is able to provide a larger brightness value.

To be specific, the driving circuit may include a driving transistor, a gate electrode of which is the control end of the driving circuit, a first electrode of which is the first end of the driving circuit, and a second electrode of which is the second end of the driving circuit.

To be specific, the energy storage circuit may include a storage capacitor, a first end of which is connected to the control end of the driving circuit, and a second end of which is connected to a fifth voltage end.

During the implementation, the data write-in circuit may include a data write-in transistor, a gate electrode of which is connected to the gate line, a first electrode of which is connected to the data line, and a second electrode of which is connected to the data write-in node.

To be specific, the light-emitting element may be an OLED, an anode of which is the anode of the light-emitting element, and a cathode of which is the cathode of the light-emitting element.

The pixel circuit will be described hereinafter in more details in conjunction with a specific embodiment.

Figure 4:
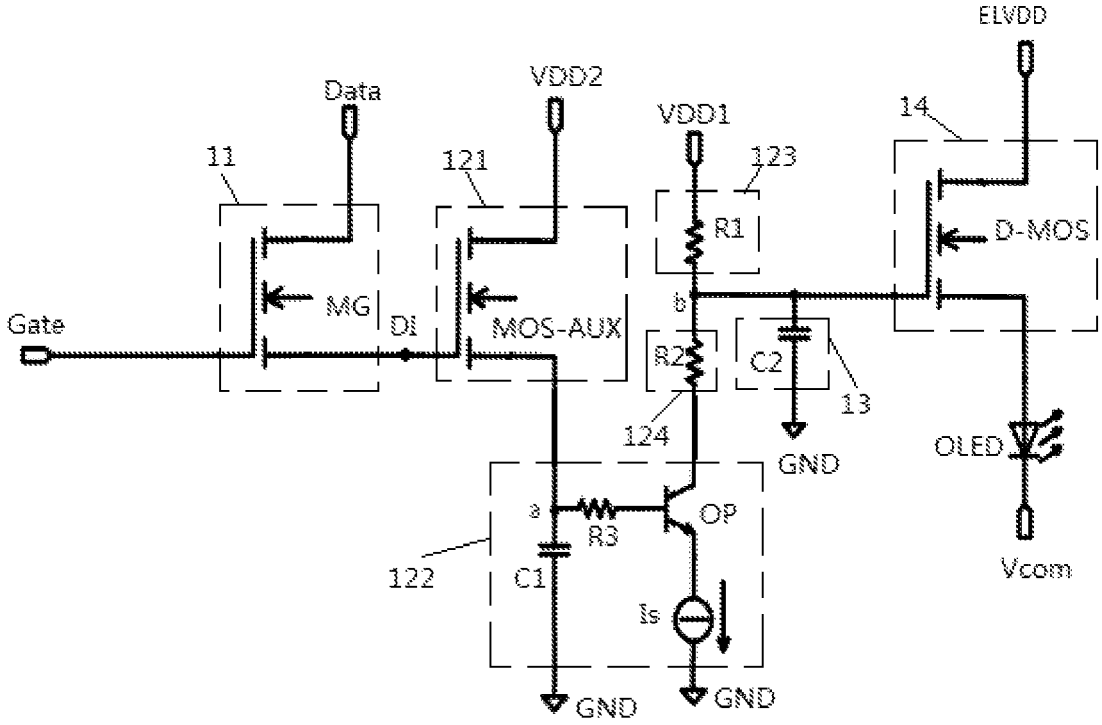
FIG. 4 is yet another circuit diagram of the pixel circuit according to one embodiment of the present disclosure.

As shown in FIG. 4, the pixel circuit includes the data write-in circuit 11, the voltage amplification circuit 12, the energy storage circuit 13, the driving circuit 14 and the OLED. The data write-in circuit 11 includes a data write-in transistor MG, the energy storage circuit 13 includes a storage capacitor C2, and the driving circuit 14 includes a driving transistor D-MOS. A gate electrode of MG is connected to the gate line Gate, a drain electrode thereof is connected to the data line Data, and a source electrode thereof is connected to the data write-in node DI.

The voltage amplification circuit 12 includes the conversion sub-circuit 121, the current amplification sub-circuit 122, the first resistor sub-circuit 123 and the second resistor sub-circuit 124. The conversion sub-circuit 121 includes the conversion transistor MOS-AUX. The current amplification sub-circuit 122 includes the first capacitor C1, the third resistor R3, the amplification transistor OP and the current source Is. The first resistor sub-circuit 123 includes the first resistor R1, and the second resistor sub-circuit 124 includes the second resistor R2. A first end of R1 is connected to the first voltage end VDD1, a second end of R1 is connected to a gate electrode of D-MOS, and a first end of R2 is connected to the gate electrode of D-MOS too. A gate electrode of MOS-AUX is connected to the data write-in node DI, a drain electrode thereof is connected to the second voltage end VDD2, and a source electrode thereof is connected to the conversion node a. A first end of C1 is connected to the conversion node a, and a second end of C1 is connected to the ground end GND. A first end of R3 is connected to the conversion node a. A base of OP is connected to a second end of R3, a collector thereof is connected to a second end of R2, and an emitter thereof is connected to the ground end GDN via Is. Is is configured to provide a stable current to the current amplification sub-circuit 122. A first end of C2 is connected to the gate electrode of D-MOS, and a second end of C2 is connected to the ground end GND. A drain electrode of D-MOS is connected to the power source voltage end ELVDD, a source electrode of D-MOS is connected to an anode of the OLED, and a cathode of the OLED is configured to receive a common electrode voltage Vcom.

In the pixel circuit as shown in FIG. 4, the third voltage end, the fourth voltage end and the fifth voltage end may each be, but not limited to, a ground end. In actual use, they may also be low voltage ends.

In the pixel circuit as shown in FIG. 4, the cathode voltage end is configured to output, but not limited to, the common electrode voltage Vcom. In actual use, the cathode voltage end may also be a ground end or a low voltage end.

In the pixel circuit as shown in FIG. 4, the control node b may be a node connected to the gate electrode of the driving transistor D-MOS, and OP may be a common-emitter amplification transistor.

In the pixel circuit as shown in FIG. 4, MG, MOS-AUX and D-MOS are each an NMOSFET, and OP is an NPN-type transistor, but the types of these transistors will not be particularly defined herein.

In the pixel circuit as shown in FIG. 4, R2 and R3 each have a relatively small resistance, and R1 is arranged at a peripheral circuit board. In the embodiments of the present disclosure, through the current amplification sub-circuit 122 of the pixel circuit, it is able to amplify a tiny current signal. In addition, a thin signal line may be provided for a pixel driving circuit (this is because R2 and R3 arranged on a display substrate (which may be a silicon substrate) each have a small resistance), so it is able to reduce a size of a silicon wafer, and increase an integration level of the OLED pixel circuit.

During the implementation, the data write-in transistor MG may serve as a switch, so it may be an MOSFET. The conversion transistor MOS-AUX and the driving transistor D-MOS may serve as switches and additionally have amplification and driving functions respectively, so they may each be an MOSFET.

Figure 5:
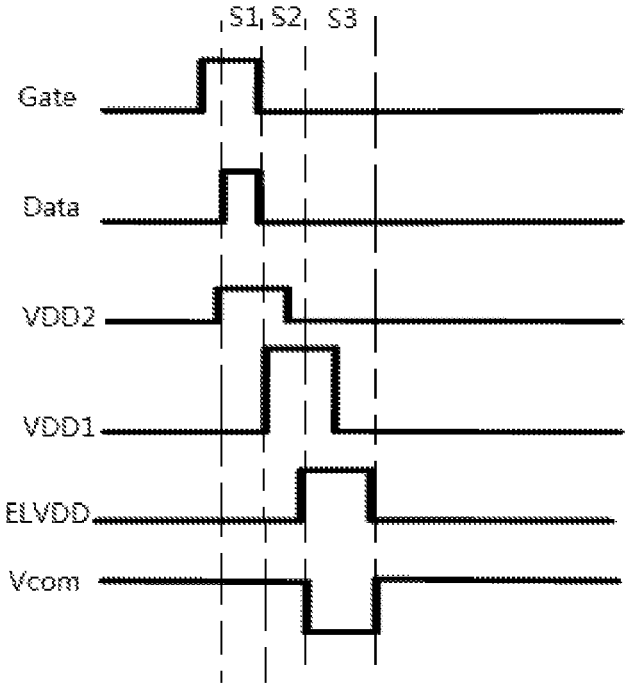
FIG. 5 is a time sequence diagram of the pixel circuit in FIG. 4.

As shown in FIG. 5, during the operation of the pixel circuit in FIG. 4, at a data write-in stage S1, Gate may output a high level, so as to turn on MG, thereby to write the data voltage Vdata of the data line Data into DI. VDD2 may output a high level, so as to enable a gate-to-source voltage Vgs-a of MOS-AUX to be greater than a threshold voltage Vth-a of MOS-AUX and enable a gate-to-drain voltage Vgd-a of MOS-AUX to be smaller than Vth-a, thereby to enable MOS-AUX to operate at a saturation region. At this time, the data voltage Vdata may be converted into the data current Ia, and C1 may be charged through Ia, so as to increase the potential at the conversion node a. The data current Ia may flow from VDD2 to the conversion node a, and $Ia=\frac{1}{2}*K_{AUX}(Vdata-Ua-Vth-a)^2$, where Vth-a represents the threshold voltage of MOS-AUX, $K_{AUX}$ represents a current coefficient of MOS-AUX and it is determined in accordance with a width-to-length ratio of a channel of MOS-AUX, and Ua represents the potential at the conversion node a.

At an amplification stage S2, VDD1 may output a first high level Vdd1. At this time, Ub is greater than Ua, i.e., a potential at the collector of OP is greater than a voltage of the base of OP, so OP may operate in an amplification state, and $Ib=\beta*Ia$, where $\beta$ represents a current amplification factor when OP is in the amplification state and $\beta$ is greater than 1, and Ib represents an amplified data current. Ib may flow from VDD1 to the control node b, and Ub=Vdd1−R1*Ib. At this time, Ub may be just the driving voltage, and the potential at the control node b may be maintained by C2. Ub may be equal to the potential at the control node b, and Ua may be equal to the potential at the conversion node a, and Ub may be greater than Vdata. Hence, it is able to increase a driving current Ioled flowing through the OLED at a driving stage S3, thereby to provide a large display brightness value.

At the driving stage S3, the power source voltage end ELVDD may output the high power source voltage Vdd, and at this time, Vcom is a low voltage, so as to enable the gate-to-source voltage and the gate-to-drain voltage of D-MOS to be greater than the threshold voltage Vth-d of D-MOS, thereby to control D-MOS to operate at the saturation region and enable D-MOS to generate the driving current Ioled to drive the OLED to emit light. At this time, $Ioled=\frac{1}{2}*Kd(UbVoled-Vth-d)^2=\frac{1}{2}*Kd(R2*Ib-Voled-Vth-d)^2$, where Kd represents a current coefficient of D-MOS and it is determined in accordance with the width-to-length ratio of the channel of D-MOS, and Voled represents a voltage of the anode of the OLED.

During the implementation, in the pixel driving circuit as shown in FIG. 4, MG, MOS-AUX and D-MOS may also be P-channel MOS (PMOS) FETs, and OP may be a PNP-type transistor. At this time, when it is necessary to control MOS-AUX to operate at the saturation region, each of the gate-to-source voltage Vgs-a and the gate-to-drain voltage Vgd-a of MOS-AUX needs to be smaller than the threshold voltage Vth-a of MOS-AUX, and when it is necessary to control D-MOS to operate at the saturation region, each of the gate-to-source voltage Vgs-d and the gate-to-drain voltage Vgd-d of D-MOS needs to be smaller than the threshold voltage Vth-d of D-MOS.

The present disclosure further provides in some embodiments a method for driving the above-mentioned pixel circuit which includes: writing, by the data write-in circuit, a data voltage of the data line into the data write-in node under the control of the gate line; amplifying, by the voltage amplification circuit, the data voltage to acquire a driving voltage, and outputting the driving voltage to the control end of the driving circuit; maintaining, by the energy storage circuit, a potential at the control end of the driving circuit; and controlling, by the driving circuit, the power source voltage end to be electrically connected to, or electrically disconnected from, the light-emitting element under the control of the control end.

According to the method in the embodiments of the present disclosure, through the additional voltage amplification circuit, the data voltage may be amplified and outputted to the driving circuit so as to drive the light-emitting element to emit light. As compared with the related art, a larger driving current is applied to the driving circuit, so it is able to provide a larger brightness value.

During the implementation, the voltage amplification circuit may include a conversion sub-circuit, a current amplification sub-circuit, a first resistor sub-circuit and a second resistor sub-circuit. A driving period may include a data write-in stage, an amplification stage and a driving stage. The method may include: at the data write-in stage, writing, by the data write-in circuit, the data voltage of the data line into the data write-in node under the control of the gate line, converting, by the conversion sub-circuit, the data voltage into a data current, and outputting the data current through the conversion node; at the amplification stage, amplifying, by the current amplification sub-circuit, the data current to acquire an amplified data current, transmitting the amplified data current to the second resistor sub-circuit and the first resistor sub-circuit so as to control the potential at the control end of the driving circuit to be the driving voltage, and maintaining, by the energy storage circuit, the potential at the control end of the driving circuit; and at the driving stage, outputting a high power source voltage from the power source voltage end, inputting a low voltage by the cathode voltage end, and driving, by the driving circuit, the light-emitting element to emit light under the control of the control end.

The present disclosure further provides in some embodiments an OLED display device including the above-mentioned pixel circuit.

During the implementation, the OLED display device may further include a silicon substrate on which the pixel circuit is arranged.

During the implementation, the pixel circuit may include a data write-in circuit, a voltage amplification circuit and a driving circuit. The data write-in circuit may include a data write-in transistor, the voltage amplification circuit may include a conversion transistor, and the driving circuit may include a driving transistor. The data write-in transistor may be an MOSFET or a thin film transistor TFT, and the conversion transistor and the driving transistor may be both MOSFETs.

During the implementation, the OLED display device may further include a silicon substrate and a circuit board arranged at a side of the silicon substrate. The pixel circuit may include a voltage amplification circuit, and the voltage amplification circuit may include a first resistor sub-circuit arranged on the circuit board. Members of the pixel circuit, other than the first resistor sub-circuit, may include arranged on the silicon substrate.

In actual use, the first resistor sub-circuit may be arranged on the circuit board at a side of the silicon substrate, so as to reduce a size of the silicon substrate and facilitate the integration level of the OLED display device.

During the implementation, the circuit board may be a Flexible Printed Circuit (FPC) or a Printed Circuit Board (PCB).

The OLED display device may be any product or member having a display function, e.g., mobile phone, flat-panel computer, television, display, laptop computer, digital photo frame or navigator.

The above embodiments are for illustrative purposes only, but the present disclosure is not limited thereto. Obviously, a person skilled in the art may make further modifications and improvements without departing from the spirit of the present disclosure, and these modifications and improvements shall also fall within the scope of the present disclosure.

What is claimed is:

1. A pixel circuit, comprising a data write-in circuit, a voltage amplification circuit, an energy storage circuit, a driving circuit and a light-emitting element, wherein the driving circuit comprises a control end, a first end and a second end;

the data write-in circuit is connected to a gate line, a data line and a data write-in node, and configured to write a data voltage of the data line into the data write-in node under the control of the gate line;

the voltage amplification circuit is connected to the data write-in node and the control end of the driving circuit, and configured to amplify the data voltage to acquire a driving voltage, and output the driving voltage to the control end of the driving circuit;

the energy storage circuit is connected to the control end of the driving circuit, and configured to maintain a potential at the control end of the driving circuit;

the first end of the driving circuit is connected to a power source voltage end, and the second end of the driving circuit is connected to an anode of the light-emitting element;

the driving circuit is configured to control the power source voltage end to be electrically connected to, or electrically disconnected from, the anode of the light-emitting element under the control of the control end; and a cathode of the light-emitting element is connected to a cathode voltage end, wherein the voltage amplification circuit comprises a conversion sub-circuit, a current amplification sub-circuit, a first resistor sub-circuit and a second resistor sub-circuit, wherein a first end of the first resistor sub-circuit is connected to a first voltage end, and a second end of the first resistor sub-circuit is connected to the control end of the driving circuit;

a first end of the second resistor sub-circuit is connected to the control end of the driving circuit;

the conversion sub-circuit is connected to the data write-in node and a conversion node, and configured to convert the data voltage written into the data write-in node into a data current, and output the data current through the conversion node; and the current amplification sub-circuit is connected to the conversion node and a second end of the second resistor sub-circuit, and configured to amplify the data current to acquire an amplified data current, and output the amplified data current to the second resistor sub-circuit and the first resistor sub-circuit, so as to control the potential at the control end of the driving circuit to be the driving voltage.

2. The pixel circuit according to claim 1, wherein the conversion sub-circuit comprises a conversion transistor, a gate electrode of the conversion transistor is connected to the data write-in node, a first electrode of the conversion transistor is connected to a second voltage end, and a second electrode of the conversion transistor is connected to the conversion node.

3. The pixel circuit according to claim 1, wherein the current amplification sub-circuit comprises a capacitor sub-circuit, a resistor sub-circuit, an amplification transistor, and a current source, wherein a first end of the capacitor sub-circuit is connected to the conversion node, and a second end of the capacitor sub-circuit is connected to a third voltage end;

a first end of the resistor sub-circuit is connected to the conversion node, and a second end of the resistor sub-circuit is connected to a base of the amplification transistor;

a collector of the amplification transistor is connected to the second end of the second resistor sub-circuit, and an emitter of the amplification transistor is connected to a fourth voltage end through the current source; and the current source is configured to provide a current flowing from the emitter of the amplification transistor to the fourth voltage end.

4. The pixel circuit according to claim 1, wherein the driving circuit comprises a driving transistor, a gate electrode of the driving transistor is the control end of the driving circuit, a first electrode of the driving transistor is the first end of the driving circuit, and a second electrode of the driving transistor is the second end of the driving circuit.

5. The pixel circuit according to claim 1, wherein the energy storage circuit comprises a storage capacitor, a first end of the storage capacitor is connected to the control end of the driving circuit, and a second end of the storage capacitor is connected to a fifth voltage end.

6. The pixel circuit according to claim 1, wherein the data write-in circuit comprises a data write-in transistor, a gate electrode of the data write-in transistor is connected to the gate line, a first electrode of the data write-in transistor is connected to the data line, and a second electrode of the data write-in transistor is connected to the data write-in node.

7. The pixel circuit according to claim 1, wherein the light-emitting element is an Organic Light-Emitting Diode (OLED), an anode of the OLED is the anode of the light-emitting element, and a cathode of the OLED is the cathode of the light-emitting element.

8. A method for driving the pixel circuit according to claim 1, comprising:

writing, by the data write-in circuit, a data voltage of the data line into the data write-in node under the control of the gate line;

amplifying, by the voltage amplification circuit, the data voltage to acquire a driving voltage, and outputting the driving voltage to the control end of the driving circuit;

maintaining, by the energy storage circuit, a potential at the control end of the driving circuit; and controlling, by the driving circuit, the power source voltage end to be electrically connected to, or electrically disconnected from, the light-emitting element under the control of the control end.

9. The method according to claim 8, wherein the voltage amplification circuit comprises a conversion sub-circuit, a current amplification sub-circuit, a first resistor sub-circuit and a second resistor sub-circuit, and a driving period comprises a data write-in stage, an amplification stage and a driving stage, wherein the method comprises:

at the data write-in stage, writing, by the data write-in circuit, the data voltage of the data line into the data write-in node under the control of the gate line, converting, by the conversion sub-circuit, the data voltage into a data current, and outputting the data current through the conversion node;

at the amplification stage, amplifying, by the current amplification sub-circuit, the data current to acquire an amplified data current, transmitting the amplified data current to the second resistor sub-circuit and the first resistor sub-circuit to control the potential at the control end of the driving circuit to be the driving voltage, and maintaining, by the energy storage circuit, the potential at the control end of the driving circuit; and at the driving stage, outputting a high power source voltage by the power source voltage end, inputting a low voltage by a cathode voltage end, and driving, by the driving circuit, the light-emitting element to emit light under the control of the control end.

10. An OLED display device, comprising the pixel circuit according to claim 1.

11. The OLED display device according to claim 10, further comprising a silicon substrate on which the pixel circuit is arranged.

12. The OLED display device according to claim 11, further comprising a circuit board arranged at a side of the silicon substrate, wherein the pixel circuit comprises a voltage amplification circuit, the voltage amplification circuit comprises a first resistor sub-circuit arranged on the circuit board, and members of the pixel circuit, other than the first resistor sub-circuit, are arranged on the silicon substrate.

13. The OLED display device according to claim 11, wherein the pixel circuit comprises a data write-in circuit, a voltage amplification circuit and a driving circuit;

the data write-in circuit comprises a data write-in transistor, the voltage amplification circuit comprises a conversion transistor, and the driving circuit comprises a driving transistor; and the data write-in transistor is an MOSFET or TFT, and the conversion transistor and the driving transistor are both MOSFETs.

14. The OLED display device according to claim 10, wherein the pixel circuit comprises a data write-in circuit, a voltage amplification circuit and a driving circuit;

the data write-in circuit comprises a data write-in transistor, the voltage amplification circuit comprises a conversion transistor, and the driving circuit comprises a driving transistor; and the data write-in transistor is a metal-oxide-semiconductor (MOS) field effect transistor (FET) or thin film transistor (TFT), and the conversion transistor and the driving transistor are both MOSFETs.

15. A method for driving a pixel circuit, wherein the pixel circuit comprises a data write-in circuit, a voltage amplification circuit, an energy storage circuit, a driving circuit and a light-emitting element, the driving circuit comprises a control end, a first end and a second end;

the data write-in circuit is connected to a gate line, a data line and a data write-in node, and configured to write a data voltage of the data line into the data write-in node under the control of the gate line;

the voltage amplification circuit is connected to the data write-in node and the control end of the driving circuit, and configured to amplify the data voltage to acquire a driving voltage, and output the driving voltage to the control end of the driving circuit;

the energy storage circuit is connected to the control end of the driving circuit, and configured to maintain a potential at the control end of the driving circuit;

the first end of the driving circuit is connected to a power source voltage end, and the second end of the driving circuit is connected to an anode of the light-emitting element;

the driving circuit is configured to control the power source voltage end to be electrically connected to, or electrically disconnected from, the anode of the light-emitting element under the control of the control end; and a cathode of the light-emitting element is connected to a cathode voltage end, the method comprises:

writing, by the data write-in circuit, a data voltage of the data line into the data write-in node under the control of the gate line;

amplifying, by the voltage amplification circuit, the data voltage to acquire a driving voltage, and outputting the driving voltage to the control end of the driving circuit;

maintaining, by the energy storage circuit, a potential at the control end of the driving circuit; and controlling, by the driving circuit, the power source voltage end to be electrically connected to, or electrically disconnected from, the light-emitting element under the control of the control end, wherein the voltage amplification circuit comprises a conversion sub-circuit, a current amplification sub-circuit, a first resistor sub-circuit and a second resistor sub-circuit, and a driving period comprises a data write-in stage, an amplification stage and a driving stage, wherein the method comprises:

at the data write-in stage, writing, by the data write-in circuit, the data voltage of the data line into the data write-in node under the control of the gate line, converting, by the conversion sub-circuit, the data voltage into a data current, and outputting the data current through the conversion node;

at the amplification stage, amplifying, by the current amplification sub-circuit, the data current to acquire an amplified data current, transmitting the amplified data current to the second resistor sub-circuit and the first resistor sub-circuit to control the potential at the control end of the driving circuit to be the driving voltage, and maintaining, by the energy storage circuit, the potential at the control end of the driving circuit; and at the driving stage, outputting a high power source voltage by the power source voltage end, inputting a low voltage by a cathode voltage end, and driving, by the driving circuit, the light-emitting element to emit light under the control of the control end.

16. An OLED display device, comprising a pixel circuit, a silicon substrate on which the pixel circuit is arranged and a circuit board arranged at a side of the silicon substrate, the pixel circuit comprises a data write-in circuit, a voltage amplification circuit, an energy storage circuit, a driving circuit and a light-emitting element, the driving circuit comprises a control end, a first end and a second end;

the data write-in circuit is connected to a gate line, a data line and a data write-in node, and configured to write a data voltage of the data line into the data write-in node under the control of the gate line;

the voltage amplification circuit is connected to the data write-in node and the control end of the driving circuit, and configured to amplify the data voltage to acquire a driving voltage, and output the driving voltage to the control end of the driving circuit;

the energy storage circuit is connected to the control end of the driving circuit, and configured to maintain a potential at the control end of the driving circuit;

the first end of the driving circuit is connected to a power source voltage end, and the second end of the driving circuit is connected to an anode of the light-emitting element;

the driving circuit is configured to control the power source voltage end to be electrically connected to, or electrically disconnected from, the anode of the light-emitting element under the control of the control end; and a cathode of the light-emitting element is connected to a cathode voltage end, wherein the voltage amplification circuit comprises a first resistor sub-circuit arranged on the circuit board, and members of the pixel circuit, other than the first resistor sub-circuit, are arranged on the silicon substrate.

17. The OLED display device according to claim 16, wherein the data write-in circuit comprises a data write-in transistor, the voltage amplification circuit comprises a conversion transistor, and the driving circuit comprises a driving transistor; and the data write-in transistor is a metal-oxide-semiconductor (MOS) field effect transistor (FET) or thin film transistor (TFT), and the conversion transistor and the driving transistor are both MOSFETs.

18. The OLED display device according to claim 16, wherein the data write-in circuit comprises a data write-in transistor, the voltage amplification circuit comprises a conversion transistor, and the driving circuit comprises a driving transistor; and the data write-in transistor is an MOSFET or TFT, and the conversion transistor and the driving transistor are both MOSFETs.

* * * * *